United States Patent [19]

Malinak

[11] 4,202,078

[45] May 13, 1980

[54] DEPITHER

[75] Inventor: Frank J. Malinak, Hamilton, Ohio

[73] Assignee: The Western States Machine Company, Hamilton, Ohio

[21] Appl. No.: 834,789

[22] Filed: Sep. 19, 1977

Related U.S. Application Data

[63] Continuation of Ser. No. 609,186, Sep. 2, 1975, abandoned.

[51] Int. Cl.[2] ..... D01B 1/30; B02C 13/18

[52] U.S. Cl. ..... 19/26; 19/65 A; 19/90; 241/188 R; 241/192; 241/258; 241/285 R

[58] Field of Search ..... 19/26, 90, 7, 83, 65 A, 19/95; 241/188 R, 192, 239–241, 257 R, 258, 285 R, 286, 288, 281, 191, 194; 74/417

[56] References Cited

U.S. PATENT DOCUMENTS

| | | | |
|---|---|---|---|
| 1,119,126 | 12/1914 | Sturtevant | 241/192 |
| 1,139,920 | 5/1915 | Tebbetts, Jr. | 241/192 |
| 2,082,419 | 6/1937 | Rietz | 241/188 R X |
| 2,339,733 | 1/1944 | Smith | 241/188 R X |
| 2,591,127 | 4/1952 | Brewster | 74/417 |
| 2,813,684 | 11/1957 | Jensen | 241/194 |
| 2,928,139 | 3/1960 | Adams | 19/98 |
| 2,974,701 | 3/1961 | Eberman | 241/258 X |
| 3,537,142 | 11/1970 | Villavicencio | 19/26 |
| 3,622,088 | 11/1971 | Gunkel | 19/26 X |
| 3,652,022 | 3/1972 | Miner et al. | 241/285 R X |
| 3,774,466 | 11/1973 | Bhatia et al. | 74/417 |

FOREIGN PATENT DOCUMENTS

| | | | |
|---|---|---|---|
| 1335685 | 7/1963 | France | 241/194 |

*Primary Examiner*—Louis Rimrodt
*Attorney, Agent, or Firm*—Albert C. Johnston

[57] ABSTRACT

An improved apparatus for depithing fibrous vegetable material, such as sugarcane bagasse, comprises a rotary hammer assembly suspended from a rigid framework that is supported removably on an upright enclosure which itself is supported in functioning position by a framework on its base. The hammer assembly comprises a plurality of individual stacks of hammers and their holders, each of which constitutes a unit separate from the other stacks and has means individual thereto for adjusting the radial positions of the hammers in the stack relative to a screening wall through which pith is separated from fibers by rotation of the hammer assembly. The screening wall is composed of several perforated arcuate screening sections any of which may be reached through a door in the enclosure, and may be unfastened and displaced to give access to the hammer assembly or for replacement of a screening section. The rotary hammer assembly is powered by a motor connected therewith through a drive transmission that is supported on the enclosure and includes a gear box fitting down onto the shaft of the hammer assembly.

13 Claims, 9 Drawing Figures

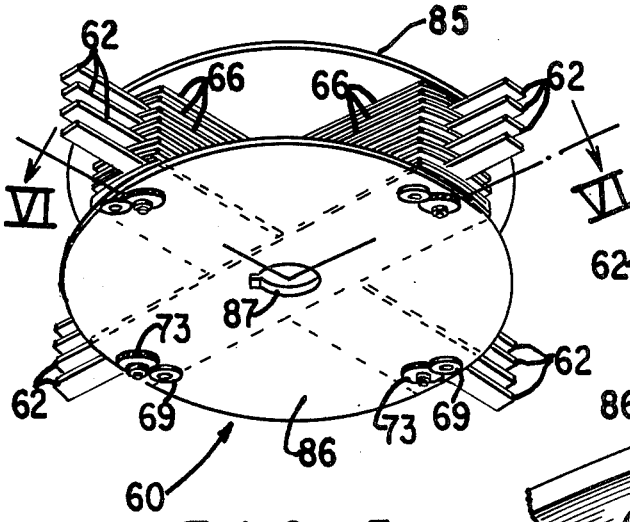
FIG. 5
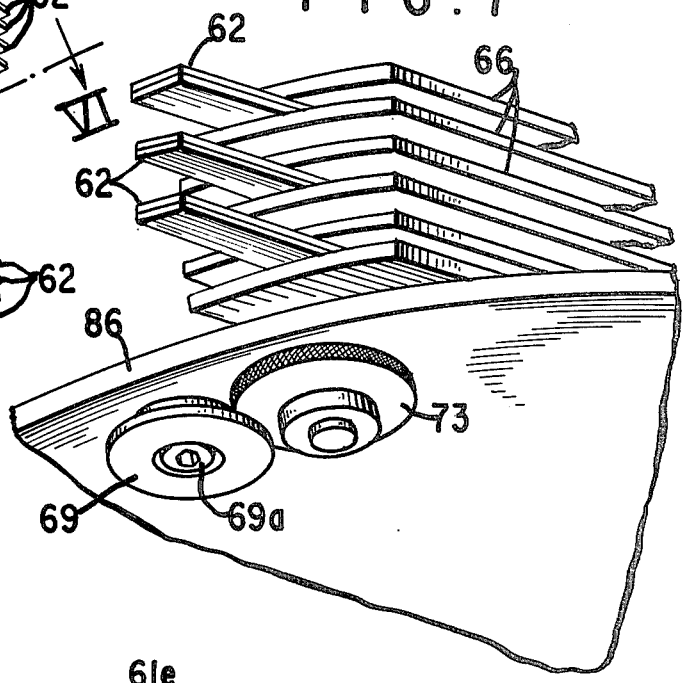
FIG. 7
FIG. 6
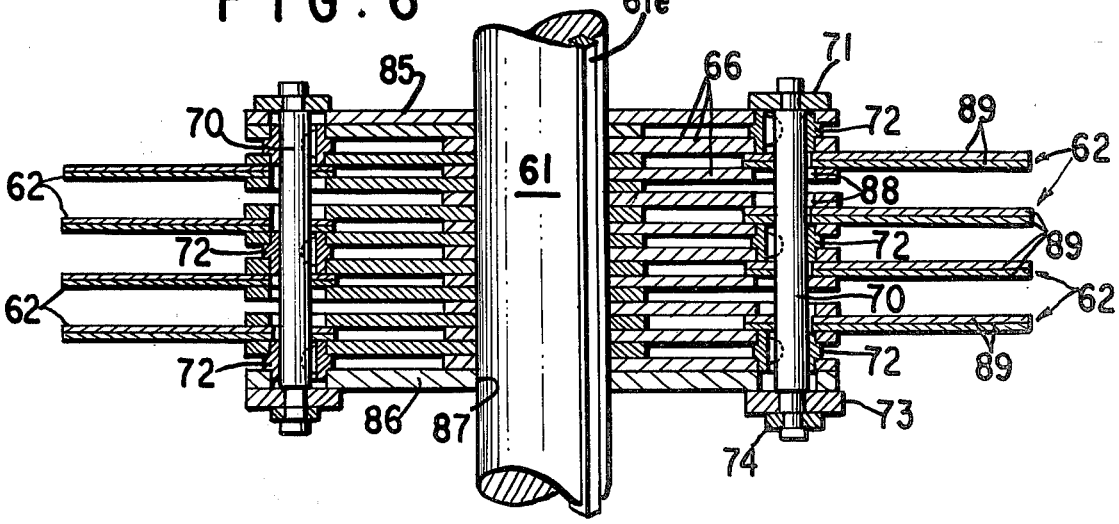
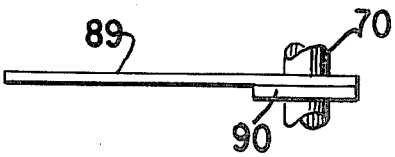
FIG. 8

DEPITHER

This is a continuation of application Ser. No. 609,186 filed Sept. 2, 1975, now abandoned.

This invention relates to an improved apparatus for processing fibrous vegetable material, e.g., bagasse, by separating the fiber from the pith portion of the material.

Fibrous vegetable materials such as straw, flax, bamboo, rice hulls, bagasse, etc. are generally characterized by the presence of elongate cellulose fibers entrained in a non-fibrous cellular spongy portion or pith. The separate recovery of the fibers and pitch of such vegetable materials is desirable, as the pith-free fibers have utility in the manufacture of paper and fiberboard products while the pith can be used as a fuel or in animal feed, litter, mulch, or other compositions.

An apparatus for separating such fiber and pith portions of fibrous vegetable materials is disclosed in U.S. Pat. No. 3,537,142. In that apparatus the material to be depithed is fed inside a cylindrical perforate screening wall enclosing a multiplicity of rotating hammers held to a central shaft. The pith portion of the material is separated from the fibers and forced through the screening wall by the action of the rotating hammers, to be collected separately from the fibers which are retained and fall inside the screening wall. Apparatus of that character has been employed principally for the depithing of bagasse.

The quality and properties of fibrous vegetable materials such as bagasse vary greatly depending on factors such as geographical location, climatic conditions, harvesting method or time of harvest and extent of processing prior to the depithing operation. In order to obtain end products of consistent quality, a depithing apparatus should be adaptable to suit the particular properties of the input material.

Additionally, it is desirable that the depithing apparatus be capable of installation at limited expense in existing factory or plant locations without requiring extensive special framework or alterations of floor structures to support the apparatus in functioning position. In this way, the apparatus may be made more suitable, for instance, for installation and use at the locations, such as in cane sugar factories, where the material to be processed is originally produced.

It is an object of the invention to provide an improved depithing apparatus that can be installed readily in functioning position without requiring extensive special framework.

Another object of the invention is to provide a rotary hammer assembly that can be readily installed in working position without requiring precisely aligned supporting structure.

Another object of the invention is to provide a rotary hammer assembly so organized that in the event of damage or excessive wear of some of the hammers, only a section or stack containing damaged or worn hammers need be attended to.

A further object is to provide a rotary hammer assembly having the hammers thereof so arranged relative to a central shaft that the working effects of the hammers may be varied in different regions of the material processing zone.

Another object of the invention is to provide a depithing apparatus the screening wall and the enclosure of which are constructed so that the hammer assembly inside the screening wall is readily accessible for adjustment or repair, and so that the screen elements of the screening wall may be quickly and economically replaced either for renovation or to adapt them to particular processing requirements.

Still another object of the invention is to provide a depithing apparatus the drive assembly, including the transmission unit, of which is supported by and easily removable from the depither in a position to power the rotary hammer assembly.

It is also a general object of the invention to provide a depithing apparatus having significant economies in design, installation, operation and maintenance.

In accordance with the invention, a depither for fibrous vegetable material, such as bagasse, is constituted by an upright enclosure having on its base a framework by which the entire apparatus may be supported in a functioning position. Supported on the top of the enclosure and bridging an opening therein is a rigid frame structure from which is suspended a rotary hammer assembly in working relation to a surrounding screening wall spaced within the enclosure to define the outer boundary of a zone for processing the material. This hammer assembly comprises a shaft and a multiplicity of hammers rotatable with the shaft for working fibrous material fed through the enclosure top opening against the screening wall. This hammer assembly can be readily installed or removed from the frame structure, and while being so installed can be aligned readily in the plumb or vertical position by gravity and maintained therein for rotational operation by suitable strut members engaging the lower end of the shaft.

In accordance with another feature of the invention, the hammers of the rotary hammer assembly are organized into several independent stacks arranged one over the other on the shaft. Each of these stacks is removable from the shaft as a unit so that any damaged or excessively worn hammers of a stack may be replaced or serviced independently of the other stacks. Additionally, the separate stacks of hammers may each be adjusted to vary the radial positions of the hammers thus setting the working relation of such hammers to the screening wall. This enables the working effects of the hammers to be varied along the screening wall to suit conditions of the material being processed.

According to a further feature of the invention, the screening wall bounding the processing zone is composed of upper and lower annular partitions and a plurality of arcuate perforate screen sections detachably fastened to and extending between the partitions. Ready access is provided to these screen sections through doors in the enclosure, enabling individual screen sections to be displaced for access to the hammer assembly for adjustment or repair thereof, or replaced in the event of damage or alternatively to provide screen sections whose open area is adapted to particular processing requirements.

Still a further feature of the invention involves the construction and arrangement of a drive assembly provided for rotation of the hammer assembly, which can be installed readily and removed as a unit without requiring supporting structures other than structures provided on the upright enclosure of the apparatus. This drive assembly comprises a transmission unit including a gear box detachably fastened to the rigid frame structure at the top of the enclosure and fitting down on the upper end of the shaft of the hammer assembly, which shaft has an upper end portion extending through the frame structure. This gear box has a vertical output shaft rotatable on bearings in the box and having on its lower end a driving socket engaged over and splined to the upper end portion of the hammer assembly shaft. A bevel ring gear on the output shaft has mated thereto a bevel gear on a horizontally extending input shaft rotatable on bearings in the box. The input shaft is connected to a drive motor through a torque-limiting coupling, all supported on structure provided on the upright enclosure.

Other objects, features and advantages of the invention will be further understood from the following detailed description and the accompanying drawings of an illustrative embodiment thereof. In the drawings:

FIG. 5 is a perspective view of a stack of hammer holders and hammers;

FIG. 6 is a cross-section taken along line VI—VI of FIG. 5.

FIG. 7 is a perspective view of a portion of a hammer stack, viewed from its underside;

FIG. 8 is a side view of an alternative arrangement of a single hammer element;

Figure 1:
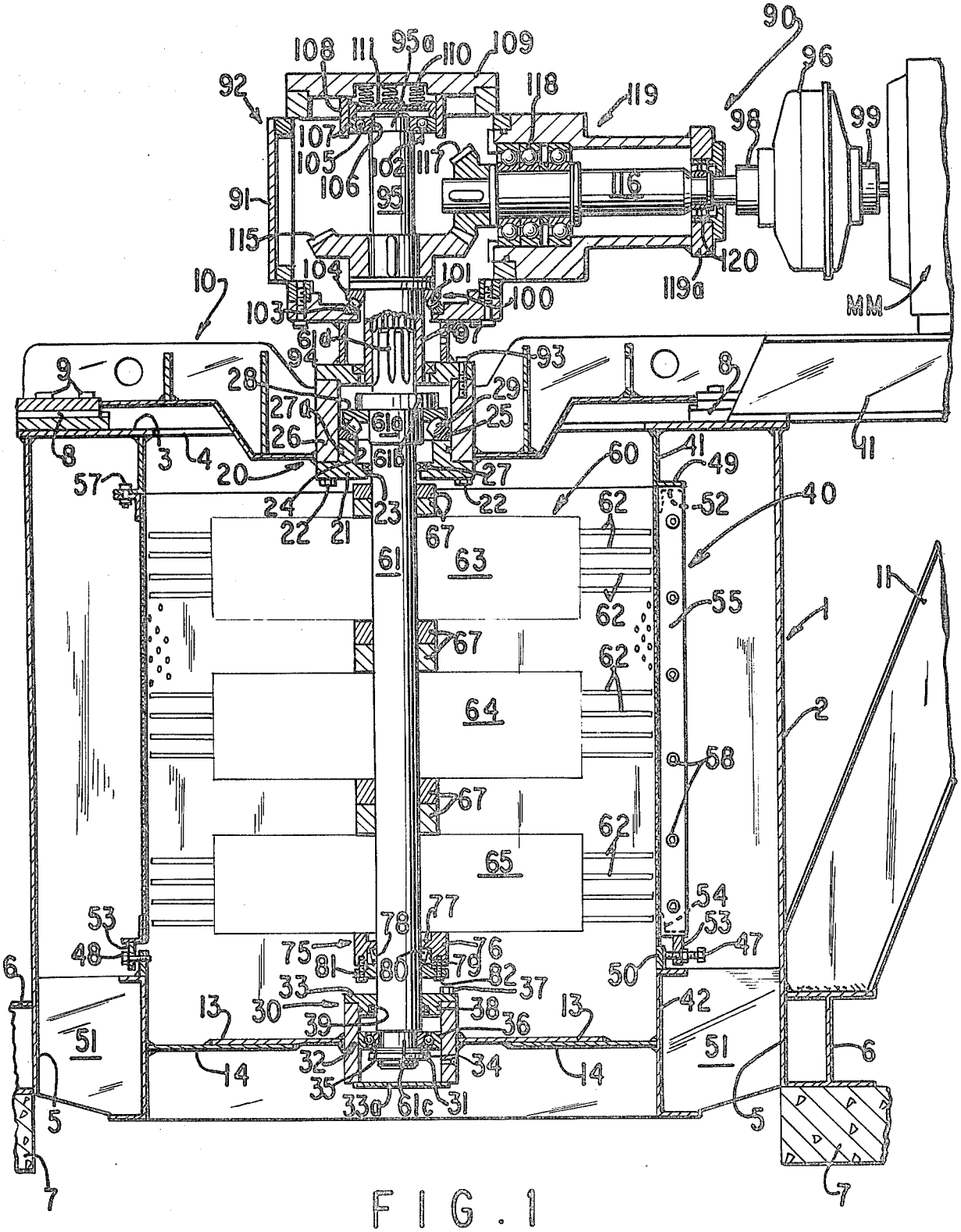
FIG. 1 is a vertical cross-sectional view through the principal working parts of a depithing apparatus embodying the invention.

As illustrated in the drawings, the apparatus for depithing fibrous vegetable material is comprised of an upright casing or enclosure 1 having a vertical side wall 2 extending between a top wall 3 having a central opening 4 therein and a lower base portion 5. Secured to this base portion is a surrounding framework 6, sufficiently strong to support the entire apparatus in functioning position. The apparatus may be installed in a factory or processing plant by fitting this framework onto a floor structure 7 or a raised supporting platform. Secured to and supported by the enclosure top wall is a rigid frame structure 10, positioned by a pair of mounting pads 8 affixed to the top wall and secured thereto by bolts 9, to bridge the opening 4. This frame structure provides the structural support for the transmission unit 92 of the drive assembly 90 mounted thereon and the rotary hammer assembly 60 suspended therefrom. Brackets 11 secured to the framework 6 and to the enclosure top wall 3 support the driving motor MM which is coupled to the transmission unit 92 through a torque-limiting hydraulic or pneumatic clutch 96.

Figure 3:
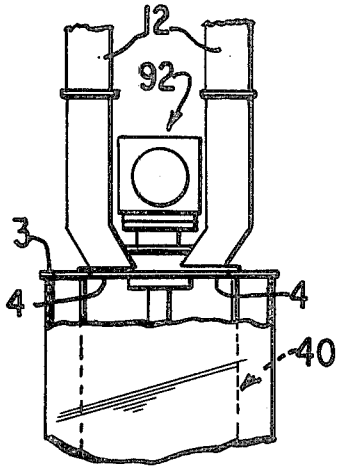
FIG. 3 is a schematic illustration of chutes for leading feed material into an upper portion of the apparatus.

Spaced inside the enclosure 1 is a cylindrical screening wall, or basket 40, comprised of four perforate screen sections 43, 44, 45 and 46 secured between upper and lower annular partitions 41 and 42, respectively. This screening wall forms the outer boundary of a zone for processing fibrous vegetable material fed into the machine through opening 4 by ingress chutes 12 (FIG. 3).

The rotary hammer assembly 60 is suspended by the rotary shaft 61 thereof from an annular upper bearing support 20 integral with the frame structure 10, so as to be coaxial with the screening wall 40. Shaft 61 has secured for rotation therewith a multiplicity of hammers 62 which are swingable relative to their holders and extend towards the screening wall to work the fibrous vegetable material fed into the processing zone inside that wall. The rotary hammer assembly can be readily installed on or removed from the upper bearing support 20, and while being so installed will be properly aligned in its plumb or vertical position by gravity as will be described below. It is maintained in that position for rotational operation by strut members 13 extending from an annular lower bearing support or housing 30 on shaft 61, which members are secured to strut members 14 fixed inside the lower annular partition 42 of the screening wall.

The screening wall comprises four perforated screen sections 43, 44, 45 and 46 secured between the upper and lower annular partitions. Each of these screen sections is accessible through doors 15 (FIG. 2) in the enclosure side wall and can be displaced to provide access to the hammer assembly. The upper end of each screen section is secured to the upper partition 41 of the screening wall, while the lower end of each screen section is secured to the lower partition 42 by a series of adjusting push screws 47 and pull screws 48. These push and pull screws enable the proper alignment of each screen section to the lower partition when the screen section is installed.

Figure 9:
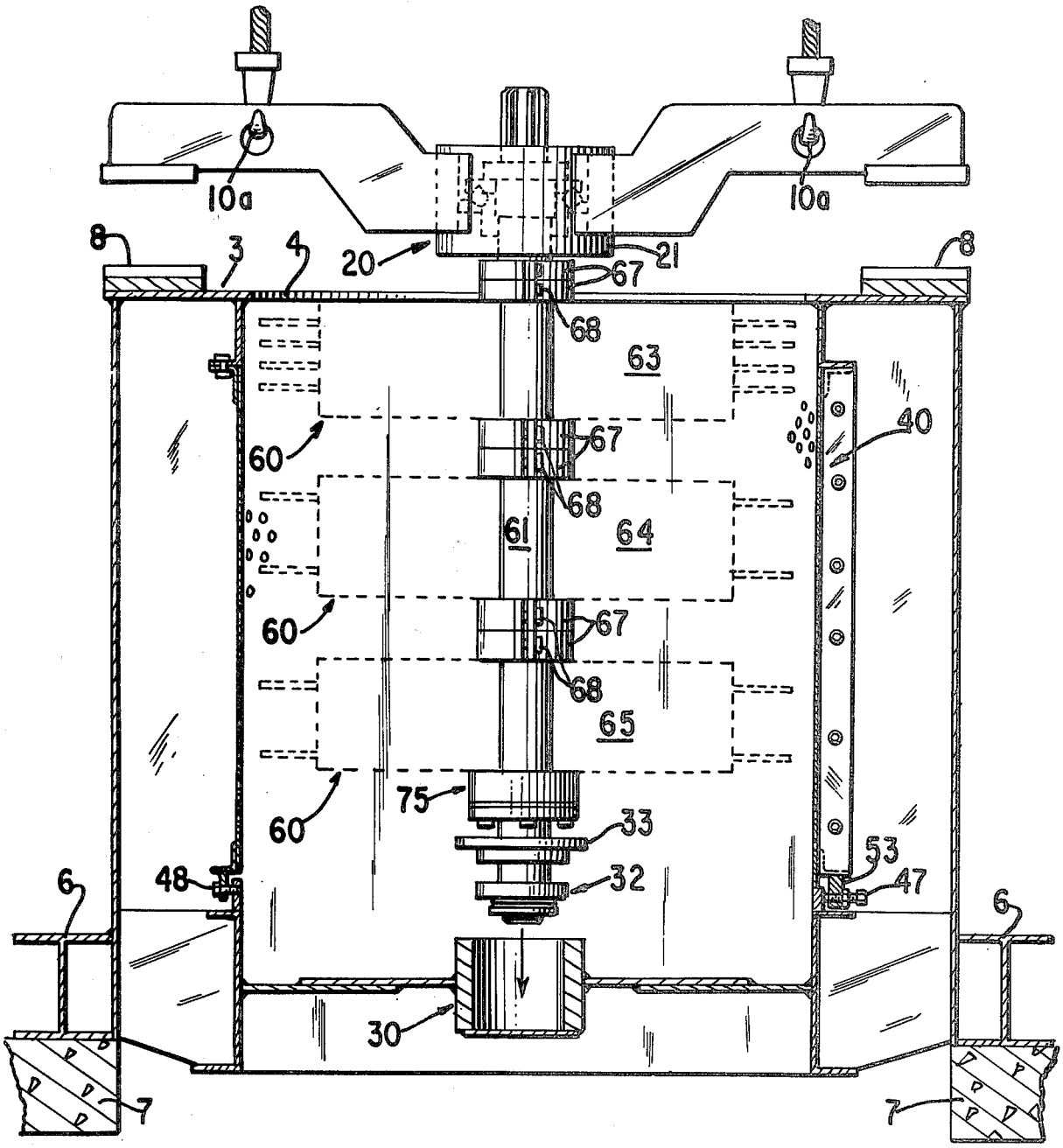
FIG. 9 is a schematic sectional view showing the rotary hammer assembly as it is being assembled in or removed from the enclosure.

The multiplicity of hammers of the hammer assembly is arranged in three distinct groupings or stacks 63, 64, 65 of hammer holders. These stacks, as shown in schematic block form in FIGS. 1 and 9, are secured one over another for rotation with shaft 61. Each of the stacks, as shown in FIGS. 5–8, comprises a plurality of elongate strips or plates 66 fitted centrally upon the shaft 61 and extending symmetrically and radially therefrom. These elongate plates are stacked alternately at right angles to one another to present four arrays of circumferentially spaced, vertically aligned end portions thereof. Positioned between pairs of aligned plate end portions of each array are hammers 62 which are swingably held in place by hammer swivel pins 70 secured in eccentric bushings 72. The hammer swivel pins, together with the eccentric bushings secured thereto, may each be turned by an indexing disc or plate 73 to vary the radial location of the hammers swingably held thereby relative to the end portion of the hammer holders, thus individually setting the working relation of the hammers of each array of aligned hammer holder end portions to the screening wall 40. Further, any one of the several stacks of hammer holders and hammers can be removed from the shaft 61 for service or replacement as a unit, enabling any damaged or excessively worn hammers or other defect in the stack to be attended to without requiring dismantling of other stacks of the hammer assembly.

Figure 2:
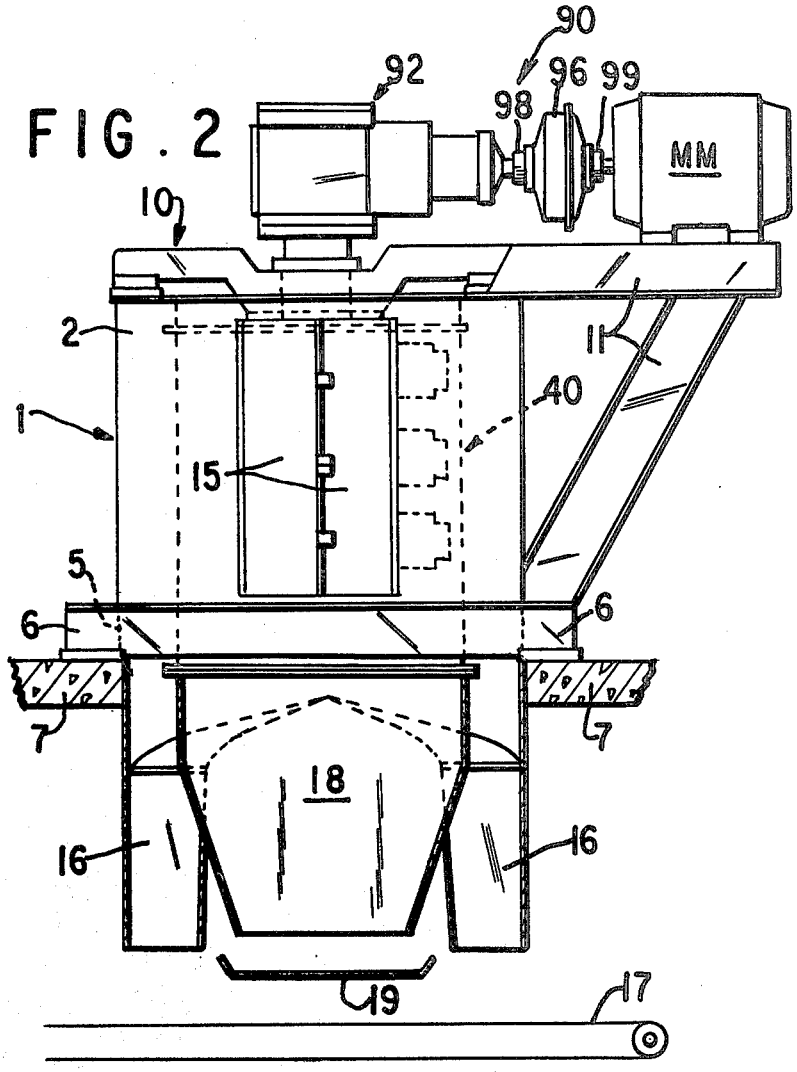
FIG. 2 is an elevational view of the apparatus as installed in relation to structures beneath it for delivering away the separated fibers and pith.

During operation, the fibrous vegetable material, e.g., bagasse, is fed through opening 4 via ingress chutes 12 into the processing zone bordered by the screening wall. The rotating hammers beat and work the material against the inner surface of the screening wall, causing the fibers to break down and become loosened from the pith, with movement of the fibers by gravity downwardly along the inside of the screening wall, while the lighter, more bulky pith is forced through the perforations in the screen sections of that wall by the rotating hammers. The hammer assembly is rotated at a high speed, for example, 1450 rpm, so that a multitude of intensive beating, kneading and rolling effects is imparted to the material under the centrifugal and rotational forces of the individual hammers. The pith portion which passes through the screen perforations falls through the outer annular space between the screening wall 40 and side wall 2 of the enclosure 1, being delivered separately from the fibers through a discharge chute 16 leading to a pith conveyor 17. The separated fibers falling down inside the screening wall pass from it through a central chute 18 onto a fiber conveyor 19, as shown in FIG. 2.

According to the invention, as illustrated in FIGS. 1 and 9, the rotary hammer assembly is supported in suspension and in the plumb position required for its high speed rotation by the mounting of its shaft 61 in the upper bearing support 20 on the frame structure 10. This bearing support comprises an annular housing 26 which is welded to that frame structure and has a bearing retainer 21 fixed to it detachably by capscrews 22. The retainer, or housing bottom wall, has an opening 23 therein through which an upper end portion of shaft 61 extends and in which the shaft is sealed by a compressible oil seal 27. An upstanding annular portion 24 of the bearing retainer, sealed to the housing wall 26 by an O-ring 27*a*, extends inside the housing to an upwardly and inwardly facing, spherically curved annular bearing seat 25. This seat supports a series of spherical roller bearings 29 which are held between it and an upper annular bearing ring 28 that fits upon an enlargement 61*a* of the upper portion of shaft 61 beneath a thrust ring 61*b* fixed to the shaft. The entire weight of the hammer assembly is carried by the bearing support 20 through the spherical thrust bearing constituted by the seat 25, rollers 29 and ring 28, with the thrust ring 61*b* applying this weight so that, due to the shaft being displaceable angularly relative to seat 25, the hammer assembly is free to attain a plumb position by gravity during installation.

The lower end portion of shaft 61 has secured thereto an anti-friction bearing unit 32, in this instance a radial ball bearing supported in a lower bearing housing 30. Bearing unit 32 comprises an inner ring 34 fitted on a reduced diameter portion 61*c* of shaft 61 and an outer ring 36 lying inside the side wall of bearing housing 30, with a series of bearing balls 35 confined between these rings. Bearing unit 32 is retained on shaft portion 61 by a lockwasher 31. The housing 30 has a cover plate 33 fixed to it by screw 37, which plate is sealed to the side wall of housing 30 by O-ring 38 and sealed to the shaft 61 by O-ring 39. A bottom plate 33*a* closes the bearing housing.

The strut members 13 are welded to the housing 30, and extend radially outward from it to overlie portions of the strut members 14 which extend radially inward from the lower annular partition 42 of the screening wall. During installation of the hammer assembly, after it has been seated on the upper bearing support and has reached the plumb position required for dynamically balanced rotation, the strut members 13 and 14 are engaged together, as by welding them, so that they will maintain the lower bearing housing and thus the lower end of shaft 61 is proper working position.

The installation of the hammer assembly is, accordingly, relatively simple, and few of the structures supporting it require manufacture to close dimensional tolerances. Additionally, as will become further evident below, the entire hammer assembly can readily be removed from the apparatus for repair, and either replaced by a like assembly or re-installed, with little loss of machine operating time and productivity.

Figure 4:
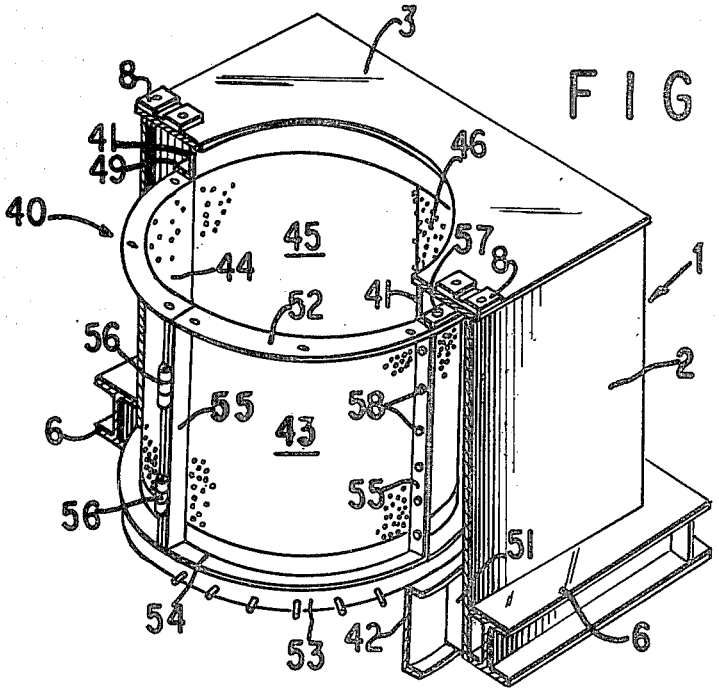
FIG. 4 is a perspective view, partly in section, of the enclosure and the enclosed screening wall, or basket, of the apparatus.

The screening wall within the enclosure 1, as noted above, is comprised of four screen sections 43, 44, 45 and 46 supported between an upper annular partition 41 and a lower annular partition 42. The upper partition 41 depends from top wall 3 and has around its lower edge an outwardly extending flange 49. The lower partition 42 is secured to side wall 2 of the enclosure by radial webs 51 and has an upstanding annular flange 50 on its upper edge. The four screen sections are each quarter-cylindrical (see FIG. 4) and each provided with upper and lower arcuate flanges 52 and 54 extending horizontally outward, and with outwardly extending side flanges 55. A depending arcuate flange 53 is fixed to each lower flange 54.

The screen sections are joined in pairs, with the adjacent side flanges of the screen sections of each pair fastened together by hinges 56. The other side flanges of these sections are joined to adjacent side flanges of the screen section of the other hinged pair by detachable bolts 58. Each of the upper arcuate flanges 52 is detachably fastened to the flange 49 on the upper partition 41 by bolts 57. Each screen section thus can be detached at the bolt locations and swung open on its hinge structure to provide access to the hammer assembly, or can be completely removed with the screen section hinged to it, through an enclosure opening at doors 15.

The vertically depending arcuate flange 53 on each screen section lies adjacent to the upstanding flange 50 on the lower partition, as seen in FIGS. 1 and 9, and is formed with openings which receive sets of push screws 47 and pull screws 48. The push screws 47 are threaded through flange 53 and their ends abut flange 50 on the lower partition, so that by rotation of the screws 47 the lower end of the related screen section may be adjusted outwardly relative to the lower partition 42. The pull screws 48 extend freely through their openings in flange 53 and are threaded through flange 50 on the lower partition, so that by rotation of these screws the lower end of the related screening section will be adjusted inward toward flange 50. The push and pull screws thus enable the inner surface of each screen section to be brought readily into vertical alignment with the inner surface of the lower partition 42, without need for exacting precision in the manufacture of the mounting flanges of the screen sections.

Upon any occasion of damage to one or more of the screen sections, such as may occur if a stone, piece of metal, or other hard object is inadvertently introduced into the processing zone with the fibrous material, the damaged screen section or sections can be reached and detached through the doors 15, and replaced for continuing operation of the depithing apparatus, without need for disassembling other or more massive parts of the apparatus and with little loss of machine operating time. Further, the screen sections may be readily removed and replaced by screen sections having larger, smaller or differently formed perforations, in order to adapt them to particular process requirements. For instance, for the processing of dry bagasse, i.e., bagasse containing up to about 20% moisture, or of bagasse introduced with a carrier liquid, the holes of the screen sections should preferably be of approximately 3.2 mm. in diameter and sufficiently numerous to provide the screen sections with about 40–45% of open area, while in the processing of moist bagasse, i.e., bagasse containing from about 20% up to about 50–52% of moisture, the holes should preferably be of about 6.35 mm. in diameter and should provide the screen sections with about 45–47% of open area.

The rotary hammer assembly 60 embodies a number of important features of construction, as shown generally in FIGS. 1 and 9 and as to certain particulars of a hammer stack in FIGS. 5–8. The hammer assembly shown is composed of three distinct groupings or stacks 63, 64 and 65 of hammer holders and hammers, which are arranged one over the other on the rotatable shaft 61. Shaft 61 is formed with a radially protruding rib or key 61*e* extending lengthwise thereof, and the stacks of hammer holders and structures for holding them in place have central openings of key hole form whereby they are fitted upon the keyed shaft for rotation with it at all times. A set of spacer rings 67 is secured to a portion of shaft 61 just below the upper bearing housing 20. These rings may each be a split ring having two mating halves secured tightly together against the shaft by capscrews 68 (FIG. 9). The upper hammer holder in stack 63 is fitted on the shaft so as to abut the top set of spacers 67 and is separated from the middle stack 64 by another set of spacers 67, while the middle stack is separated from the lower stack 65 by a third set of spacers 67. The lower stack 65 in turn is held in place on the shaft by a lock collar 75 which comprises a ring 76 having an inwardly projecting flange 77 fitting on the shaft and a recess 78 below this flange. Within the recess 78 is a pair of wedge rings 79 and 80 having inclined surfaces co-engaged as indicated in FIG. 3, and the lower wedge ring is abutted by the upper face of a thrust ring 81 the rim of which is secured to the lower end of ring 76 by capscrews 82. To lock the collar 75 and the hammer stacks above it in place on shaft 61, the capscrews 82 are tightened, forcing the wedge rings together so that ring 80 is thrust radially into tight locking engagement with the shaft.

Each stack of hammer holders comprises a multiplicity of superimposed elongate strips or plates 66 which are confined between upper and lower circular end plats 85 and 86 with hammers 62 held between adjacent outer ends of the plates 66. The end plates and the plates 66 between them each have a central keyhole shaped aperture therein, such as that seen at 87 in FIG. 5, to receive the shaft 61 and its key 61*e*. The hammer holding strips or plates 66 extend symmetrically to opposite sides of the shaft 61 and are stacked alternately at right angles to one another, thus constituting four circumferentially spaced series of hammer holders in each of which the respective end portions of the successive plates 66 are spaced apart vertically by a distance corresponding to the thickness of the centrally intervening cross plate 66, as seen in FIGS. 5–7. The plate end portions of each vertical series and the adjacent portions of the end plates 85 and 86 have vertically aligned openings 88 therein. Each of several pairs of these openings receives hub portions of a bushing 72 which is rotatable in the two openings and is formed with an eccentric bore through which a swivel pin 70 extends vertically in keyed connection with the bushing. The bushings 72 thus are eccentric relative to the swivel pin 70, which pin has its upper end secured above end plates 85 by a washer 71 and has its lower end secured below end plate 86 by a washer 74 engaged over an adjusting plate or disc 73 that is keyed to the pin 70.

The hammers 62 of each series of hammer holders have openings in their backward end portions, by which they are fitted on the swivel pin 70 at locations between the adjacent end portions of pairs of holder plates 66 not occupied by the eccentric bushings 72. Each hammer as shown in FIGS. 5–7 comprises two metal strips 89 lying together as a unit. If a less intensive working effect is desired at any location in a stack, a single strip 89 may be used as the hammer and may be kept in the desired position relative to the adjacent end portions of plates 66 by a spacing washer 84 as shown in FIG. 8. All the hammers 62 of each vertical series are swingable about the axis of their supporting hammer swivel pin 70. The hammers therefore will swing towards the screening wall 40 under centrifugal force as the hammer assembly is rotated. The distance of each series of hammers from the axis of rotation of the assembly, hence the working positions of the hammers relative to the screening wall and the dynamic balance conditions of the assembly, can be adjusted as and when desired by adjustment of the angular position of the swivel pin 70 and the eccentric bushings 72 thereon.

To facilitate such adjustment, the adjusting plate or disc 73 on the lower end of each swivel pin 70 is formed with an eccentric shape positioned like that of the eccentric bushings 72, and with a knurled edge (FIG. 7) for finger engagement, and a releasible locking device is provided to hold the adjusting plate and pin 70 in any selected position. The locking device shown comprises a stepped lock plate or disc 69 which overhangs the periphery of plate 73 and can be released from or fastened down upon plate 73 by a screw 69*a* (FIG. 7).

The eccentric adjusting plate 73 on each swivel pin 70 constitutes an indexing element for convenient setting of the hammers of each series, through their swivel pin and the eccentric bushings thereon, in the desired radial position relative to the axis of the hammer assembly and the screening wall. The eccentric plate and its lock plate 69 are preferably located on the under side of the stack, where they are relatively sheltered from fouling engagement by the material being processed. In this location, however, they are nonetheless accessible for any desired adjustment of the hammer positions; as an attendant may reach and work with any of these parts through a set of enclosure doors 15 upon disconnecting and swinging out one of the hinged screen sections of the hinged screen sections of the screening wall 40.

The convenient setting of the working positions of the hammers and the selectivity of the setting for each stack, and for each series of hammers in a stack, are important to the performance of the depithing machine. Ordinarily, as the hammers work closer to the screening wall the fiber content of the feed material is broken down more extensively and a greater separation of pith from fiber is achieved. As the clearance is increased, a greater recovery of the fiber content may be realized, but the fiber quality is likely to be lower due to an increased content of intermingled pith. For a satisfactory range of adjustment, the hammers in an apparatus according to the invention may be set to work at a clearance of as little as about ¼ in. up to about ⅝ in. from the screening wall. Since this clearance can be varied from stack to stack, it can be made smaller from stack to stack in downward direction so as to secure the optimum processing of the fibrous vegetable material as it descends along the screening wall, there being a diminishing volume of the material as the fibers become broken down and the pith removed.

The rotary hammer assembly 60, as shown in FIG. 1, is driven by a drive assembly 90 which includes a transmission unit 92 detachably connected with the upper end of shaft 61 and mounted on the frame structure 10; also the coupling 96 and the electric driving motor MM supported on the enclosure structure by brackets 11.

The drive transmission unit 92 comprises a set of right angle bevel gears 115, 117 housed in a gear box 91 which has thereon a lower flange 94 detachably fastened by capscrews 93 to the top of bearing housing 20, as a cover thereof. Bevel gear 115 is splined to an output shaft 95 disposed vertically inside the box 91 and having on its lower end a driving socket 97 engaged detachably upon the splined upper end **61*d* of shaft 61 so as to rotate shaft 61 when the bevel gears are driven. The output shaft 95 is mounted for rotation on a lower, thrust bearing unit 100 located beneath gear 115, and in a radial ball bearing unit 102 located on the top wall of box 91. The thrust bearing unit 100 is a spherical roller bearing constituted by a spherical bearing ring, or seat, 103 on a bottom wall of box 91, a lower series of spherical roller bearings 101 on seat 103 and an upper spherical bearing ring 104 secured to the shaft 95 just below gear 115. The upper bearing unit 102 includes a series of bearing balls 105 held between an inner bearing ring 106 fitted on a reduced end portion 95*a* of shaft 95 and an outer bearing ring 107 inside a cylindrical flange 108 depending from a top plate 109 of the gear box. Several compression springs 110 are compressed between the top plate 109 and a bearing plate 111 seated on the outer ring 107 of the radial bearing unit 102. The force of these springs is transmitted through unit 102 to the output shaft 95 so that this shaft is at all times pressed downward upon the thrust bearing unit 100** under a substantially constant load.

The bevel ring gear 115 on shaft 95 meshes with the bevel ring gear 117 which is splined to a horizontal input shaft 116 that extends into the gear box from one side thereof. Shaft 116 is suppoted on a series of radial ball bearings 118 mounted in a sleeve-like horizontal extension 119 of the gear box, and a radial roller bearing unit 120 in an outer end **119*a* of extension 119 holds the shaft constantly in the desired working position. Outside the box extension, the input shaft is flexibly coupled at 98 to the driven element of the torque-limiting hydraulic or pneumatic coupling 96, the driven element of which is flexibly coupled at 99** to the shaft of motor MM.

It will be apparent that, when the input shaft 116 is disconnected outside the gear box extension, for instance at coupling 98, the entire drive transmission unit 92 can be removed from the remainder of the apparatus simply by disconnecting the screws 93 and lifting the unit off the splined upper end **61*d* of shaft 61. Reattachment of the unit 92** in working position is similarly simple.

When the drive transmission unit has been removed, or before it is assembled with the other components of the apparatus, the entire rotary hammer assembly may be readily removed from, or installed or replaced in, the enclosure by moving it vertically in or out in suspension from the frame structure 10, as indicated in FIG. 9. For removal of the installed hammer assembly, the capscrew 37 on the cover plate of the lower bearing housing 30 are removed, access to them being had through enclosure doors 15 and by detachment of one of the screen sections of wall 40, and the bolts 9 anchoring the frame structure 10 are removed. Then, with all the hammers of each stack turned inward to a position in which they will pass clear through the opening 4 in top wall 3, the frame structure 10 is engaged by hoisting cables, for instance as indicated at **10*a* in FIG. 9, and lifted vertically away from the enclosure, carrying the entire hammer assembly out of it through the top opening 4. Having been so removed from the enclosure, the hammer assembly may be separated from the frame structure 10 for repair, or for replacement by a standby hammer assembly, by detaching the bottom plate 21 of the upper bearing housing 20 and lifting that housing with the rest of the frame structure 10 off the upper end portion and the thrust bearing unit of the shaft 61**. A reverse order of steps serves for suspending the hammer assembly and the frame structure and installing these components in working position.

It will be apparent to those skilled in the art that the foregoing detail description and accompanying drawings are illustrative and that the new features herein disclosed may be embodied in various forms of construction without departing from the scope of the invention, which is intended to be defined by the appended claims.

What is claimed is:

1. Apparatus for depithing fibrous vegetable material comprising: an upright enclosure supported by framework fixed to its base and having an opening in its top for an inflow of said material, a screening wall spaced inside said enclosure and forming the outer boundary of a zone for processing said material, a rigid frame structure supported detachably on the enclosure top and bridging said opening, a rotary hammer assembly inside said screening wall, said assembly comprising a shaft having an upper end portion thereof extending through said frame structure and a multiplicity of hammers rotatable with said shaft for working material in said zone against said screening wall, means on said upper end portion for supporting said shaft in suspension from said frame structure so that said assembly will hang and tends to align itself in plumb position from said structure by gravity, means including an anti-friction bearing engaging a lower end portion of said shaft and fixing it in plumbed position relative to said enclosure for holding said lower end portion radially only against displacement relative thereto, and drive means detachably engaged with the upper end of said shaft for rotating said hammer assembly, said drive means and said holding means being substantially free of the weight load of said hammer assembly, said lower end portion being detachable from said holding means so that, with said drive means detached from said shaft and said frame structure detached from said enclosure top, said hammer assembly can be removed and replaced, respectively, simply by lifting and lowering said frame structure.

2. Apparatus according to claim 1, said holding means including a housing supporting said bearing and fixed in place by strut members respectively extending radially outward from said housing and radially inward from a structure fixed inside said enclosure base, said strut members being engaged together in a relative position thereof produced by said assembly having and aligning itself in said plumb position by gravity.

3. Apparatus according to claim 1, said supporting means including an annular thrust bearing support fixed to said frame structure, anti-friction bearings rollable on said support, and a bering ring on said upper shaft portion, said ring overlying and being seated on said rollable bearings.

4. Apparatus according to claim 3, said bearing support comprising an annular housing fixed to a central portion of said frame structure and presenting an inwardly facing, spherically curved annular bearing seat, said rollable bearings being spherical roller bearings confined between said seat and said ring.

5. Apparatus according to claim 1, said hammers being displaceable to an inward position toward said shaft, said top opening being smaller in diameter than said screening wall but larger in diameter than said hammer assembly when said hammers are in said inward position, said frame structure comprising portions thereof at opposite sides of said supporting means which are engageable by hoisting means and liftable thereby for lifting said hammer assembly as a unit through said opening and out of said enclosure when said hammers are in said inward position and said frame structure and said shaft are detached from said enclosure.

6. Apparatus for depithing fibrous vegetable material comprising: an upright enclosure supported by framework fixed to its base and having an opening in its top for an inflow of said material, a screening wall spaced inside said enclosure and forming the outer boundary of a zone for processing said material, a rigid frame structure supported on the enclosure top and bridging said opening, a rotary hammer assembly inside said screening wall, said assembly comprising a shaft having an upper end portion thereof extending through said frame structure and a multiplicity of hammers rotatable with said shaft for working material in said zone against said screening wall, means for supporting said shaft from said frame structure, and drive means detachably engaged with the upper end of said shaft for rotating said hammer assembly, said drive means including a transmission unit detachably mounted on said frame structure and connected with the upper end of said shaft for rotating said hammer assembly, said transmission unit comprising a gear box detachably fastened to said frame structure, a vertical output shaft rotatable on bearings in said box and having on its lower end a driving socket engaged over and splined to said upper shaft end, a bevel ring gear on said output shaft, an input shaft extending horizontally into said box and rotatable on bearings therein, and a bevel gear on said input shaft meshing with said bevel ring gear, said bearings of said output shaft comprising a radial ball bearing unit on the upper end thereof and a thrust roller bearing unit having bearing rings fixed respectively to a lower portion of said box and to said output shaft beneath said ring gear, and spring means compressed between a top of said box and said radial bearing unit to keep the load on said thrust bearing unit subatantially constant.

7. Apparatus according to claim 6, said drive means further including a driving motor mounted on a support bracket fixed to said enclosure and a troque-limiting coupling connecting the shaft of said motor with said input shaft.

8. An apparatus for depithing fibrous vegetable material comprising an upright enclosure having an opening in its top for an inflow of said material and a screening wall spaced inside said enclosure and forming the outer boundary of a zone for processing said material by the beating action of a rotary hammer assembly including a multiplicity of hammers rotated inside said wall, said screening wall comprising upper and lower annular partitions fixed inwardly of said enclosure and a plurality of arcuate perforate screen sections detachably fastened to and between said partitions and detachably fastened together to constitute a substantially cylindrical perforate wall region surrounding the paths of rotation of said hammers, each said screen section having thereon upper and lower arcuate flanges the upper of which is fastened detachably to a flange on said lower partition by means which are radially adjustable for aligning the inner surface of such screen section with that of said lower partition.

9. Apparatus according to claim 8, said radially adjustable means comprising pull screws extending through openings in said lower flange and threaded in said flange on said lower partition and push screws threaded in said lower flange and abutting said flange on said lower partitions.

10. Apparatus according to claim 8, there being four of said screen sections in two pairs thereof with the screen sections of each pair hinged together at their adjacent edges so that any of said sections upon being detached along its edges other than the hinged edge may be swung outward to give access to said hammer assembly.

11. Apparatus according to claim 8, there being four of said screen sections in two pairs thereof with the screen sections of each pair hinged together at their adjacent edges so that any of said sections upon being detached along its edges other than the hinged edge may be swung outward to give access to said hammer assembly, said enclosure comprising door means therein which are operable to give access to and enable removal of any of said screen sections.

12. Apparatus for depithing fibrous vegetable material comprising: an upright enclosure supported by framework fixed to its base and having an opening in its top for an inflow of said material, a screening wall spaced inside said enclosure and forming the outher boundary of a zone for processing said material, a rigid frame structure supported on the enclosure top and bridging said opening, a rotary hammer assembly inside said screening wall, said assembly comprising a shaft having an upper end portion thereof extending through said frame structure and a multiplicity of hammers rotatable with said shaft for working material in said zone against said screening wall, and means for suspending said shaft from said frame structure so that said assembly will hang plumb therefrom by gravity; and means engaging a lower end portion of said shaft for securing the same against displacement away from the plumb position;

said supporting means including an annular bearing support fixed to said frame structure, anti-friction bearings rollable on said support and a bearing ring on said upper shaft portion, said ring being seated on said bearings and said shaft and said bearings being displaceable angularly relative to said support under the weight of said assembly;

said hammer assembly comprising a plurality of stacks of hammer holders fixed one over another on said shaft and each constituting a unit separate from the other of said stacks, each said stack including a plurality of superimposed hammer holders extending radially from said shaft and hammers secured swingably to outer end portions of said holders; each said stack comprising means individual thereto for adjusting the radial positions of the hammers thereof relative to their respective holder end portions and thus setting the working relation of such hammers to said screening wall;

said hammer holders of each said stack comprising elongate plates fitted centrally upon said shaft and extending symmetrically to opposite sides thereof, said plates being stacked alternately at right angles to one another to present four circumferentially spaced series of end portions thereof with the plate end portions of each series spaced apart vertically and having plurality of said hammers secured therebetween, the plate end portions of each said series having vertically aligned openings therein, and a hammer swivel pin extending through said openings with the hammers of the series swivelled on said pin, said pin having thereon eccentric bushings fitting into some of said openings and rotatable therein by said pin for setting the hammer of the series in working position relative to said screening wall;

said screening wall comprising upper and lower annular partitions fixed inwardly of said enclosure and a plurality of arcuate perforate screen sections detachably fastened to and extending between said partitions and detachably fastened together to constitute a substantially cylindrical perforated wall region surrounding the paths of rotation of said hammers;

each said screen section having thereon upper and lower arcuate flanges the upper of which is fastened detachably to a flange on said upper partition and the lower of which is fastened detachably to a flange on said lower partition by means which are radially adjustable for aligning the inner surface of such screen section with that of said lower partition;

said enclosure comprising door means therein which are openable to give access to and enable removal of any of said screen sections;

and a drive assembly including a transmission unit detachably mounted on said frame structure and connected with the upper end of said shaft for rotating said hammer assembly, said transmission unit comprising a gear box detachably fastened to said frame structure, a vertical output shaft rotatable on bearings in said box and having on its lower end a driving socket engaged over and splined to said upper shaft end, a bevel ring gear on said output shaft, an input shaft extending horizontally into said box and rotatable on bearings therein, and a bevel gear on said input shaft meshing with said bevel ring gear; said drive assembly further including a driving motor mounted on a support bracket fixed to said enclosure and a torque-limiting coupling connecting the shaft of said motor with said input shaft.

13. Apparatus for depithing fibrous vegetable material comprising: an upright enclosure supported by framework fixed to its base and having an opening in its top for an inflow of said material, a screening wall spaced inside said enclosure and forming the outer boundary of a zone for processing said material, a rigid frame structure supported on the enclosure top and bridging said opening, a rotary hammer assembly inside said screening wall, said assembly comprising a shaft having an upper end portion thereof extending through said frame structure and a multiplicity of hammers rotatable with said shaft for working material in said zone against said screening wall, means for supporting said shaft from said frame structure, and drive means for rotating said hammer assembly, said hammer assembly comprising a plurality of stacks of hammer holders fixed one over another on said shaft and each constituting a unit separate from the other of said stacks, each said stack including a plurality of superimposed hammer holders extending radially from said shaft and hammers secured swingably to outer end portions of said holders, said hammer holders of each said stack comprising elongate plates fitted centrally upon said shaft and extending symmetrically to opposite sides thereof, said plates being stacked alternately at right angles to one another to present four circumferentially spaced series of end portions thereof with the plate and portions of each series spaced apart vertically and having a plurality of said hammers secured therebetween, the plate end portions of each said series having vertically aligned openings therein and a hammer swivel pin extending through said openings with the hammers of the series swivelled on said pin, at least some of said hammers being each constituted by two contiguous rigid strips lying one over the other and having respective inner end portions thereof swivelled individually on one of said swivel pins at a location between two adjacent ones of said plate end portions, at least one other of said hammers being constituted by a single one of said rigid strips of which an inner end portion is swivelled on one of said swivel pins at a location between two adjacent ones of said plate end portions, each said one strip being held in place axially by a spacer washer fitted on said swivel pin between its said inner end portion and one of said adjacent plate end portions.

* * * * *